United States Patent [19]

Pavio

[11] Patent Number: 5,008,639

[45] Date of Patent: Apr. 16, 1991

[54] COUPLER CIRCUIT

[76] Inventor: Anthony M. Pavio, 1813 Edgewater Dr., Plano, Tex. 75075

[21] Appl. No.: 413,558

[22] Filed: Sep. 27, 1989

[51] Int. Cl.[5] ..... H01P 5/18

[52] U.S. Cl. ..... 333/116; 333/238

[58] Field of Search ..... 333/116

[56] References Cited

U.S. PATENT DOCUMENTS

| | | | |
|---|---|---|---|
| 3,512,110 | 5/1970 | Clar | 333/116 |
| 3,575,674 | 4/1971 | Howe, Jr. | 333/116 |
| 4,375,054 | 2/1983 | Pavio | 333/116 |
| 4,673,958 | 6/1987 | Bagraktaroglu | 333/116 X |
| 4,809,356 | 2/1989 | Peckham et al. | 333/116 X |

OTHER PUBLICATIONS

Sachse, *A Wide-Band 3-DB Coupler, etc.,* 1973 European Microwave Conference, vol. I, 4–7 Sept. 1973, Brussels, Belgium.

Malherbe et al., *Directional Couplers Using Semi-Re--Entrant Coupled Lines,* Microwave Journal, Nov. 1987.

*Primary Examiner*—Paul Gensler

[57] ABSTRACT

A coupler circuit (22) is provided including a substrate (24) having a base conductor (26) connected thereto. A conductive layer (28) is adjacent the substrate (24) and separated from conductors (32, 34) by a dielectric layer (30). The conductive layer (28) is operable to electromagnetically couple the first conductor (32) to the second conductor (34).

28 Claims, 1 Drawing Sheet

COUPLER CIRCUIT

BACKGROUND OF THE INVENTION

A variety of coupling methods have been used to realize tightly coupled structures for microstrip and stripline applications. The conductors may be placed in close proximity to one another in order to achieve coupling. However, when hard substrates are employed, tight coupling can usually be obtained only with interdigitated structures. Even where this technique is used, coupling values tighter than −3 dB are still difficult to obtain in planar media which include microstrip.

The interdigitated structure currently used to realize tight coupling requires complex processes in its fabrication. Further, the use of an interdigitated structure gives rise to high losses due to the required conductor narrowing mandated by interdigitated techniques. Standard coupling techniques utilizing proximate placement of the conductors in order to achieve coupling require accurate control of the gap between the two coupled conductors. Further, there are fabrication limitations which prevent the conductors from being constructed too close to one another. Additionally, where the conductors are relatively close to one another, there exists a possibility of voltage breakdown therebetween.

Therefore, a need has arisen for a coupler circuit which may be utilized in order to tightly couple microstrip conductors while eliminating the stringent requirements for fabrication of the prior interdigitated and proximate conductor configurations.

SUMMARY OF THE INVENTION

In accordance with the present invention, a coupling circuit and the method of fabrication thereof are provided which substantially eliminate or reduce disadvantages and problems associated with prior coupling techniques.

A coupler circuit constructed in accordance with the present invention includes a first conductor adjacent a substrate, a second conductor adjacent to the substrate and a third conductive layer adjacent both to the first and second conductors. The conductive layer is adjacent to the first and second conductors in order to induce a current in the second conductor responsive to a current generated in the first conductor.

The coupler circuit of the present invention may further include a dielectric layer between the conductive layer and the first and second conductors. The dielectric layer may comprise polyamide while the substrate may comprise gallium arsenide or alumina. The coupling circuit of the present invention may be constructed such that the first and second conductors are in contact with the substrate while the conductive layer is disposed outwardly therefrom. Alternatively, the conductive layer may be in contact with the substrate while the first and second conductors are disposed outwardly therefrom.

The present invention provides the technical advantage of yielding a coupling configuration whereby very tight coupling constants may be realized. Another technical advantage of the present invention is that the distance between the first and second conductors need not be precisely controlled. Still another technical advantage of the present invention is that the capacitance between the first and second conductors is independent of the capacitance from both conductors to a second reference point, such as ground.

BRIEF DESCRIPTION OF THE DRAWINGS

For a more complete understanding of the present invention, and the advantages thereof, reference is now made to the following detailed description taken in conjunction with the accompanying drawings, in which.

DETAILED DESCRIPTION OF THE INVENTION

Figure 1A:
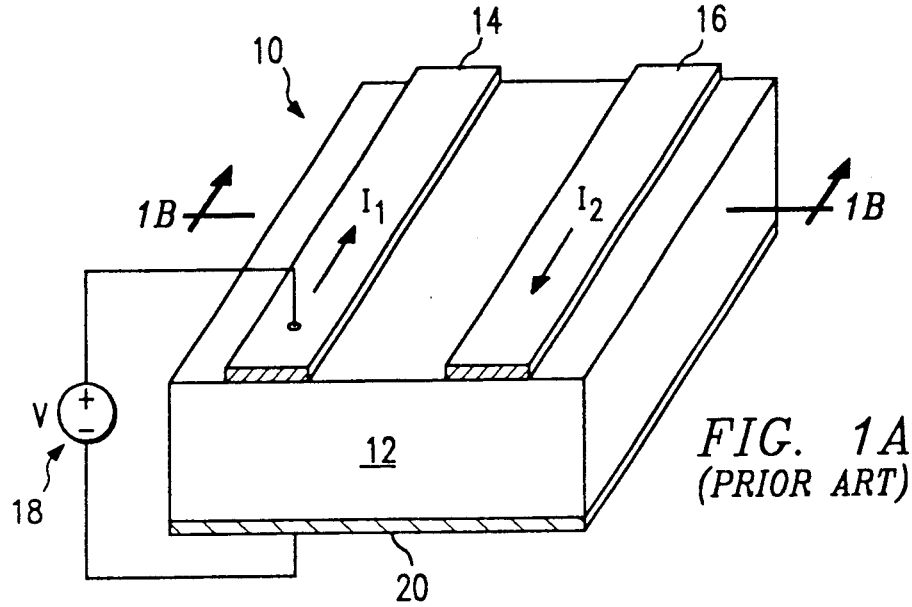
FIG. 1A (PRIOR ART)
FIG. 1*a* illustrates a perspective view of a prior art coupling configuration.
Figure 1B:
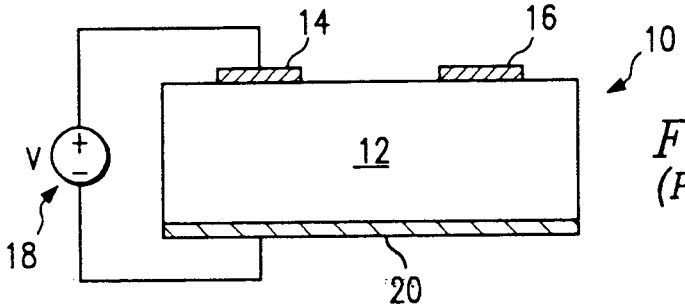
FIG. 1B (PRIOR ART)
FIG. 1*b* illustrates a cross-sectional view of the prior art configuration of FIG. 1*a;*
Figure 2:
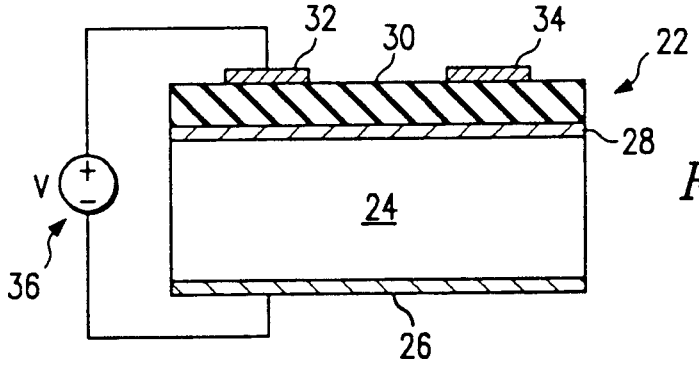
FIG. 2 illustrates a cross-sectional view of a coupling circuit constructed in accordance with the present invention.
Figure 3:
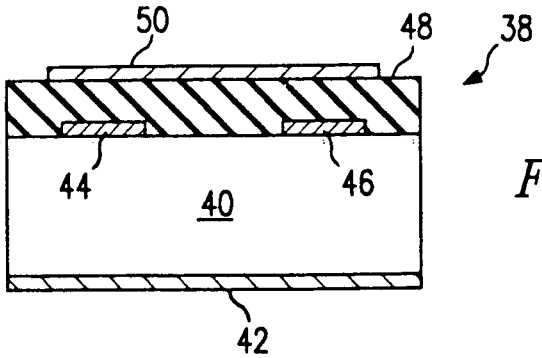
FIG. 3 illustrates a cross-sectional view of an alternative embodiment of a coupling circuit constructed in accordance with the present invention.

The preferred embodiment of the present invention is best understood by referring to FIGS. 1—3 of the drawings, like numerals being used for like and corresponding parts of the various drawings.

FIG. 1*a* illustrates a perspective view, and FIG. 1*b* illustrates a cross-sectional view, of a prior art coupling configuration indicated generally at 10. A substrate 12 has a first strip conductor 14 and second strip conductor 16 formed thereon. For exemplary purposes, a voltage supply 18 is shown connected between strip conductor 14 and a base conductor 20. In the instance where voltage supply 18 is activated, a current, $I_1$, will be generated and flow in first strip conductor 14. The electric and magnetic field generated due to current $I_1$ flowing through first strip conductor 14 will induce a second current, $I_2$, flowing in the opposite direction within second strip conductor 16. For purposes of the present invention, this power transfer phenomenon is known as electromagnetic coupling between the first and second strip conductors 14 and 16.

In coupling technology, there exists a need to configure coupling circuits such that a percentage of the total power input to a first conductor may be coupled, or transferred, to a second conductor. Under prior art coupling configuration 10 of FIGS. 1*a–b,* in order to effect tighter coupling, first and second strip conductors 14 and 16 must be moved toward one another. In other words, coupling is inversely proportional to the distance between the first and second strip conductors 14 and 16. However, the impreciseness of fabrication processes places practical limitations on how close first strip conductor 14 may be constructed relative to second strip conductor 16. Still further, where conductors 14 and 16 are formed too close to one another, there exists the possibility of voltage breakdown therebetween. In the prior art, coupling from conductor 14 to coupling 16 is at most on the order of 25 percent. In other words, only approximately 25 percent of the total power input to first strip conductor 14 may be coupled to second strip conductor 16.

FIG. 2 illustrates a cross-sectional view of a planar coupling configuration 22 constructed in accordance with the present invention. A substrate 24 is formed having a base conductor 26 connected thereto. Substrate 24 is typically a low dielectric constant microwave substrate such as Teflon-glass, and in the preferred embodiment comprises gallium arsenide or alumina. A conductive layer 28 is adjacent substrate 24 and may be in contact therewith. Conductive layer 28 in the preferred embodiment extends along substantially the full length of substrate 24. Conductive layer 28 may be formed by plating or sputtering a metal layer on the surface of substrate 24. Alternatively, a highly doped semiconductor material could be disposed within substrate 24 thereby forming a conductive layer 28. A dielectric layer 30 is adjacent conductive layer 28. In the preferred embodiment, dielectric layer 30 comprises polyamide. The polyamide may be applied in liquid form and spun to form a uniform layer. It should be noted that other dielectric materials such as silicon-glass or nitride may be used to form dielectric layer 30. For example, a layer of nitride could be deposited or grown over conductive layer 28 A first conductor 32 and a second conductor 34 are adjacent dielectric layer 30. First and second conductors 32 and 34 in the preferred embodiment are strip conductors. Conductors 32 and 34 extend along the length of substrate 24 and are substantially parallel to conductive layer 28. Conductors 32 and 34 may be formed by plating a metal, such as gold, on top of dielectric layer 30. Other conductive materials may also be used to form conductors 32 and 34. For exemplary purposes, a voltage supply 36 is connected between first strip conductor 32 and base conductor 26. Although not illustrated, conductors 32 and 34 are at some point connected to ground, either directly, or through some load (not shown) which is itself connected to ground.

In operation, conductive layer 28 may be permitted to float, or may be set at a reference potential. Base conductor 26 is connected to operate as the ground plane for planar coupling configuration 22. When voltage supply 36 is activated, as known in the art, conductive layer 28 will have no effect on the field between first conductor 32 and base conductor 26. Similarly, conductive layer 28 will have no effect on the field between second conductor 34 and base conductor 26. A first capacitance, $C_1$, will be realized between first conductor 32 and conductive layer 28. Due to the symmetry of planar coupling configuration 22, approximately the same capacitance, $C_1$, will also be realized between second conductor 34 and conductive layer 28. Capacitance $C_1$ will depend on the surface area of conductors 32 and 34, the surface area of conductive layer 28, the distance between conductive layer 28 and conductors 32 and 34, and the dielectric constant of the material chosen for dielectric layer 30.

A second capacitance, $C_2$, will be realized between conductive layer 28 and ground. Because base conductor 26 is connected to ground, second capacitance $C_2$ will be realized between conductive layer 28 and base conductor 26. Second capacitance $C_2$ will depend on the surface area of conductive layer 28, the surface area of base conductor 26, the distance between conductive layer 28 and base conductor 26, and the dielectric constant of substrate 24.

The magnitude of the electromagnetic coupling between conductors 32 and 34 is directly proportional to the ratio of $C_1/C_2$ Accordingly, both $C_1$ and $C_2$ may be adjusted to effect a desirable coupling constant. Thus, all of the parameters set forth above affecting $C_1$ and $C_2$ may be adjusted to obtain both desirable capacitances as well as a very tight coupling constant.

Due to the extreme flexibility provided by this structure, various ranges of dimensions may be used in order to achieve a desired coupling effect. Typically, first and second conductors 32 and 34 may be on the order of 0.002 inches in width and 0.0002 inches in height. As the height of dielectric layer 30 is increased, then the capacitance, and thus the coupling between first and second conductors 32 and 34 is decreased. Typically, dielectric layer 30 is on the order 0.0002–0.0004 inches in height. Further, the material comprising dielectric layer 30 may be chosen to have a desirable dielectric constant. It should also be noted that the coupling between first and second conductors 32 and 34, in accordance with the present invention, is no longer dependent upon the distance therebetween and, therefore this distance need not be limited. The height of substrate 24 may be adjusted in order to achieve a desired capacitance between both first and second conductor 32 and 34 and base conductor 26. Typically, substrate 24 is on the order of 0.004 inches in height. By properly adjusting the above parameters, coupling may be dramatically increased above the levels of the prior art. Indeed, under the present invention, coupling magnitudes approaching 100 percent may be realized by properly adjusting the noted structural parameters.

FIG. 3 illustrates a cross-sectional view of alternative coupling configuration 38 constructed in accordance with the present invention. A substrate 40 is shown having a base conductor 42 connected thereto. A first and second conductor 44 and 46 are adjacent substrate 40 and in contact therewith. Again, first and second conductors 44 and 46 are preferably strip conductors. A dielectric layer 48, preferably of polyamide, is adjacent substrate 40 and first and second strip conductors 44 and 46. A conductive layer 50 is adjacent dielectric layer 48.

From a comparison of FIGS. 2 and 3, it may be appreciated that the components therein are the same, but have been relocated relative to substrates 24 and 40. In both instances, the first and second conductors are adjacent to a corresponding substrate and are separated from a conductive layer by a dielectric layer. In either instance, the combination of the dielectric and the conductive layer operate to effectively couple the first and second conductors As discussed in connection with FIG. 2, the dimensions and materials of the components of FIG. 3 may be adjusted in order to achieve the desired capacitance between the components therein, and thus effect the necessary coupling constant.

Although the present invention has been described in detail, it should be understood that various changes, substitutions and alterations can be made herein without departing from the spirit and scope of the invention as defined by the appended claims.

What is claimed is:

1. A coupler circuit, comprising:

a first conductor adjacent and substantially parallel to a substrate;

a second conductor adjacent and substantially parallel to said substrate and coplanar with said first conductor; and a conductive layer substantially parallel with said first and second conductors such that a current is induced in said second conductor responsive to a current generated in said first conductor and coupling of said second conductor to said first conductor by said conductive layer; and a dielectric layer between said conductive layer and said first and second conductors, wherein said dielectric layer is selected from the group consisting of nitride, polyamide and silicon-glass.

2. The coupler circuit of claim 1 wherein said conductive layer contacts said substrate.

3. The coupler circuit of claim 2 wherein said first and second conductors are outwardly disposed from said substrate and said conductive layer.

4. The coupler circuit of claim 1 wherein said first and second conductors contact said substrate.

5. The coupler circuit of claim 4 wherein said conductive layer is outwardly disposed from said substrate and said first and second conductors.

6. The coupler circuit of claim 1 wherein said substrate comprises gallium arsenide.

7. The coupler circuit of claim 1 wherein said substrate comprises alumina.

8. The coupler circuit of claim 1 wherein said substrate comprises Teflon-glass.

9. The coupler circuit of claim 1 wherein said first and second conductors comprise strip conductors.

10. The coupler circuit of claim 1 wherein said conductive layer is substantially parallel to said first and second conductors.

11. A coupler circuit, comprising:

a first strip conductor adjacent and substantially parallel to a substrate;

a second strip conductor adjacent and substantially parallel to said substrate and coplanar with said first strip conductor;

a conductive layer adjacent and substantially parallel to said first and second strip conductors such that said first strip conductor may be electromagnetically coupled to said second strip conductor through said conductive layer; and a dielectric layer between said conductive layer and said first and second strip conductors, said dielectric layer selected from the group consisting of nitride, polyamide and silicon-glass.

12. The coupler circuit of claim 11 wherein said conductive layer contacts said substrate and said first and second strip conductors are outwardly disposed from said substrate and said conductive layer.

13. The coupler circuit of claim 11 wherein said first and second strip conductors contact said substrate and said conductive layer is outwardly disposed from said substrate and said first and second strip conductors.

14. A method of forming a coupler circuit, comprising:

forming a first conductor adjacent and substantially parallel to a substrate;

forming a second conductor adjacent and substantially parallel to the substrate and coplanar with the first conductor; and forming a conductive layer substantially parallel to the first and second conductors and operable to induce a current in the second conductor responsive to a current generated in the first conductor; and forming a dielectric layer between the conductive layer and the first and second conductors, wherein the dielectric layer is selected from the group consisting of nitride, polyamide and silicon-glass.

forming a dielectric layer between the conductive layer and the first and second strip conductors, wherein the dielectric layer is selected from the group consisting of nitride, polyamide and silicon-glass.

15. The method of forming a coupler circuit of claim 14 wherein said step of forming the conductive layer comprises forming the conductive layer in contact with the substrate.

16. The method of forming a coupler circuit of claim 15 wherein said step of forming the first and second conductors comprises forming the first and second conductors outwardly from the substrate and the conductive layer.

17. The method of forming a coupler circuit of claim 14 wherein said step of forming the first and second conductors comprises forming the first and second conductors in contact with the substrate.

18. The method of forming a coupler circuit of claim 17 wherein said step of forming the conductive layer comprises forming the conductive layer outwardly from the substrate and the first and second conductors.

19. The method of forming a coupler circuit of claim 14 wherein said step of forming the first and second conductors adjacent a substrate comprises forming the first and second conductors adjacent a gallium arsenide substrate.

20. The method of forming a coupler circuit of claim 14 wherein said step of forming the first and second conductors adjacent a substrate comprises forming the first and second conductors adjacent an alumina substrate.

21. The method of forming a coupler circuit of claim 14 wherein said step of forming the first and second conductors adjacent a substrate comprises forming the first and second conductors adjacent a Teflon-glass substrate.

22. The method of forming a coupler circuit of claim 14 wherein said step of forming the first and second conductors comprises forming first and second strip conductors.

23. The method of claim 14 wherein said step of forming the conductive layer comprises forming the conductive layer substantially parallel to the first and second conductors.

24. A coupler circuit formed by the method of claim 14.

25. A method of forming a coupler circuit, comprising:

forming a first strip conductor adjacent and substantially parallel to a substrate;

forming a second strip conductor adjacent and substantially parallel to the substrate and coplanar with the first strip conductor;

forming a conductive layer adjacent the dielectric layer and substantially parallel and adjacent the first and second conductors in order to induce a current in the second conductor responsive to a current generated in the first conductor, and a first conductor adjacent and substantially parallel to a substrate;

a second conductor adjacent and substantially parallel to said substrate and coplanar with said first conductor; and a conductive layer substantially parallel with said first and second conductors such that a current is induced in said second conductor responsive to a current generated in said first conductor and coupling of said second conductor to said first conductor by said conductive layer; and a dielectric layer between said conductive layer and said first and second conductors, wherein said dielectric layer is selected from the group consisting of nitride, polyamide and silicon-glass.

26. The method of forming a coupler circuit of claim 25 wherein:

said step of forming the conductive layer comprises forming the conductive layer in contact with the substrate; and said step of forming the first and second strip conductors comprises forming the first and second strip conductors outwardly from the substrate and the conductive layer.

27. The method of forming a coupler circuit of claim 25 wherein:

said step of forming the first and second strip conductors comprises forming the first and second strip conductors in contact with the substrate; and wherein said step of forming the conductive layer comprises forming the conductive layer outwardly from the substrate and the first and second strip conductors.

28. A coupler circuit formed by the method of claim 25.

* * * * *

UNITED STATES PATENT AND TRADEMARK OFFICE

CERTIFICATE OF CORRECTION

PATENT NO. : 5,008,639

DATED : April 16, 1991

INVENTOR(S) : Anthony M. Pavio

It is certified that error appears in the above-identified patent and that said Letters Patent is hereby corrected as shown below:

On the title page, item [73] should be --Texas Instruments Incorporated
Dallas, Texas On the title page, insert before item [57] --Rene' E. Grossman
Melvin Sharp--

Signed and Sealed this

Eighth Day of September, 1992

*Attest:*

DOUGLAS B. COMER

*Attesting Officer*

*Acting Commissioner of Patents and Trademarks*